United States Patent [19]

Hofmann

[11] Patent Number: 4,828,130

[45] Date of Patent: May 9, 1989

[54] LID, IN PARTICULAR FOR SHAKERS

[75] Inventor: Raimund Hofmann, Kreuzwertheim, Fed. Rep. of Germany

[73] Assignee: Jan Folkmar, Otelfingen/Zurich, Switzerland

[21] Appl. No.: 107,130

[22] Filed: Oct. 9, 1987

[30] Foreign Application Priority Data

Nov. 25, 1986 [DE] Fed. Rep. of Germany ..... 3640138

[51] Int. Cl.[4] ..... B65D 41/16

[52] U.S. Cl. ..... 215/317; 215/341; 215/344; 215/DIG. 1; 222/142.1; 222/151

[58] Field of Search ..... 215/317, 321, DIG. 1, 215/341, 344, 345, 318; 222/151, 142.1, 480

[56] References Cited

U.S. PATENT DOCUMENTS

| | | | |
|---|---|---|---|
| 3,069,040 | 12/1962 | Corsette | 215/344 X |
| 4,106,653 | 8/1978 | Martinelli | 215/DIG. 1 X |
| 4,106,672 | 8/1978 | Tecco et al. | 222/151 |
| 4,241,864 | 12/1980 | Kessler | 215/344 X |
| 4,369,901 | 1/1983 | Hidding | 222/151 X |
| 4,522,315 | 6/1985 | Rapp | 222/142.1 |
| 4,542,833 | 9/1985 | De Vaughn | 215/341 X |
| 4,717,034 | 1/1988 | Mumford | 215/341 X |

FOREIGN PATENT DOCUMENTS

| | | | |
|---|---|---|---|
| 0878606 | 4/1953 | Fed. Rep. of Germany | 215/DIG. 1 X |
| 8133868 | 3/1982 | Fed. Rep. of Germany . | |
| 8206774 | 7/1982 | Fed. Rep. of Germany . | |
| 1205887 | 9/1970 | United Kingdom | 215/341 |

*Primary Examiner*—David T. Fidei
*Assistant Examiner*—Nova Stucker
*Attorney, Agent, or Firm*—Townsend & Townsend

[57] ABSTRACT

A lid or a cap in particular for spice shakers consists of a lid bottom and a wall which encircles the lid bottom and projects downwardly therefrom at a substantially perpendicular angle. The inwardly directed face of the wall is provided with ribs which extend in the axial direction of the shaker, are spaced apart from each other and which when the lid is fitted to the shaker and when the lid is removed from the shaker preferably cooperate with an encircling rib formed at the upper edge portion of the spice shaker.

5 Claims, 3 Drawing Sheets

LID, IN PARTICULAR FOR SHAKERS

Figure 1:
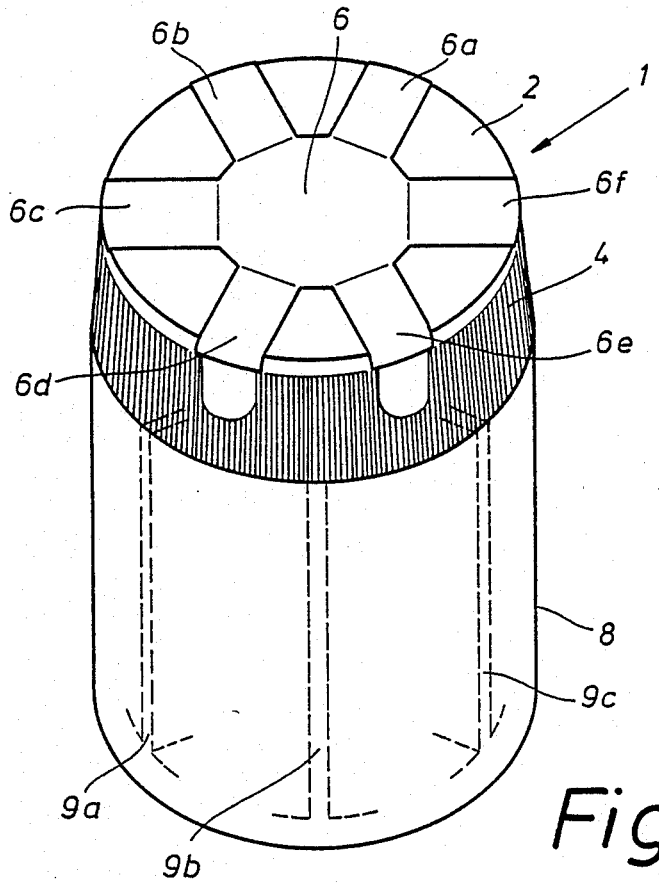

The invention relates to a lid, in particular for sprinklers or shakers. Lids in particular for shakers, are known per se. Such a lid is described in conjunction with FIG. 1 for a spice shaker which can be divided for example into various compartments for sprinkling different spices. These known lids are provided at their preferably annular wall extending downwardly from the lid bottom with transverse ribs running round the inner lid edge face and generally cooperating with a transverse rib running round the upper edge of the spice shaker, performing a sealing function as well as arresting the lid with respect to the shaker container. The rib encircling the upper edge of the spice shaker in conjunction with the ribs encircling the wall inner face of the lid have the disadvantage that due to their mutual engagement lifting of the lid from the shaker, for example for refilling the shaker, when the usual tolerances are observed is only possible by exerting a relatively high force. If the fitting tolerance between the lid and shaker body is increased this in turn has the disadvantage that the lid can be easily unintentionally lifted off the shaker, thereby spilling the material in the shaker.

The invention is based on the problem of providing a lid of the type mentioned at the beginning which on the one hand is firmly fitted on the shaker and on the other hand can be removed from the latter by applying a small force and at the same time ensures adequate sealing between lid and shaker.

One object of the invention is to avoid the above mentioned difficulties.

Another object of the invention is to reliably prevent moisture from entering the shaker.

The invention provides a lid, in particular for use in spice sprinklers or shakers, which is normally firmly mounted on the upwardly open side of the shaker and provides a good seal between lid and shaker, in particular preventing entry of moisture into the shaker.

According to one embodiment the lid comprises a closed lid bottom whilst in another embodiment in the lid bottom one or more openings are provided which can be closed by flaps of a plastic member mounted on the lid bottom.

By the formation of ribs extending in the axial direction of the shaker at the inwardly directed wall a satisfactory clamping force is exerted by the wall of the lid on the edge of the shaker which in usual manner at its open side comprises near the shaker edge an encircling rib cooperating with the longitudinal ribs in the lid wall.

According to a modification of the lid between the ribs and the lid bottom in addition on the inner face of the lid wall encircling transverse ribs are formed and this provides a firm or hard fit of the lid on the shaker over a movement region of about 5 to 6 mm, transverse ribs being disposed in said region, and thereafter smooth withdrawal, requiring little force, of the lid from the shaker is possible. In contrast to the prior art lid construction in which the lid as a whole is difficult to remove due to the transverse ribs distributed over the entire wall of the lid, with the lid according to the invention said lid can be withdrawn substantially more simply without force and this avoids that when the shaker still contains spice or the like said contents are spilled on withdrawal of the lid.

A further advantage is that the specific configuration with regard to the lid bottom can be varied in any desired manner. The lid bottom thus need not have any sprinkling opening but preferably has at least one sprinkling opening which is closable by a plastic member separately secured to the lid bottom.

The invention further provides a lid which ensures by at least one downwardly directed sealing lip formed encircling within the lid a tight closure between the lid and the upper edge of the associated shaker. Advantageously, at the inwardly directed face of the lid wall further sealing lips may be provided which ensure an additional sealing closure with respect to the edge portion of the spice sprinkler. Also advantageous is the formation of sealing lips in the region of each sprinkling opening, thereby ensuring that when the lid is closed or the flaps are closed the teeth projecting from the flaps are in sealing engagement with the sealing lips in the region of the sprinkling openings and thus entrance of moisture through the sprinkling openings when the flaps or sprinkling openings are closed is impossible.

Figure 2A:
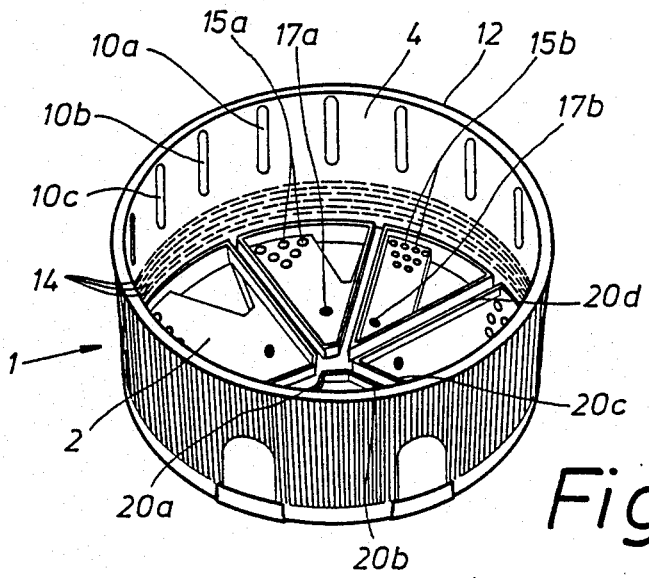
Figure 2B:
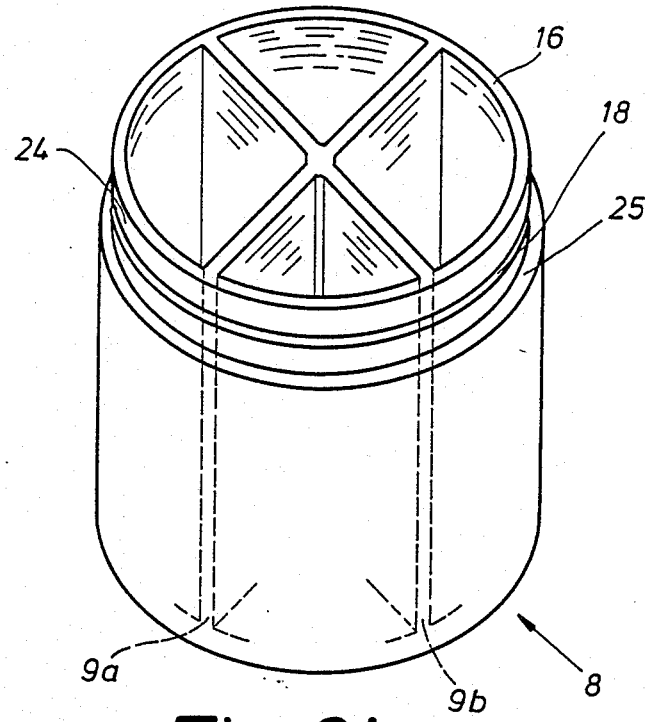
Figure 3:
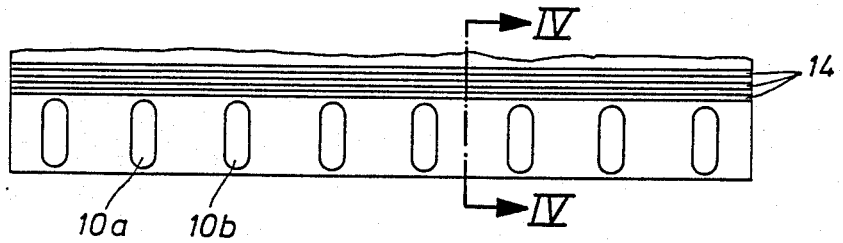
Figure 4A:
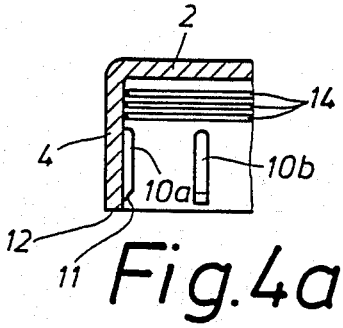
Figure 4B:
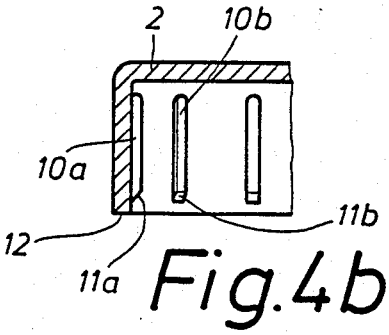
Figure 5:
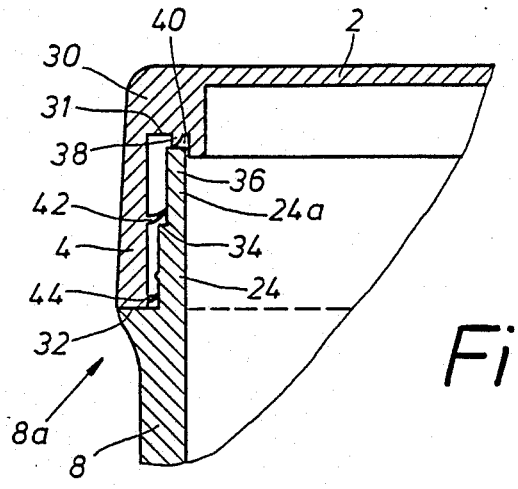
Figure 6:
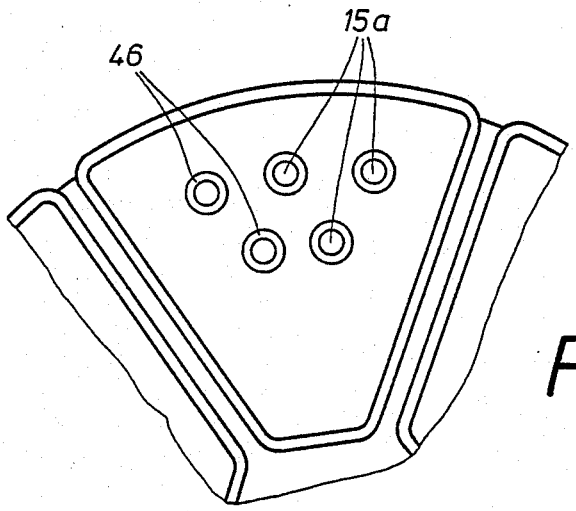
Figure 7B:
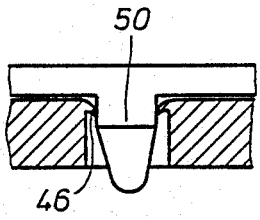
Figure 7A:
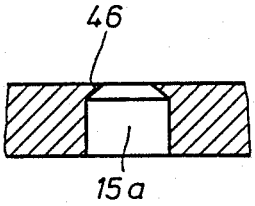

Hereinafter preferred embodiments of the invention will be explained with the aid of the drawings and the description of further features. In the drawings:

FIG. 1 is a perspective view of a spice shaker which comprises in its lid bottom a plurality of depressions with sprinkling openings which can be closed by means of flaps of a separate plastic member secured to the lid bottom, FIG. 2*a* is a view of the lid of FIG. 1 in conjunction with the longitudinal ribs according to the invention, the inner side of the lid bottom and the wall of the lid being visible, FIG. 2*b* is a perspective view of a possible embodiment of a spice shaker for use in conjunction with the lid of FIG. 2*a*, FIG. 3 is a development of the lid wall of the lid shown in FIG. 2*a*, FIGS. 4*a* and 4*b* are partial sectional views of various embodiments of the lid according to the invention, FIG. 5 shows an embodiment of a lid modified compared with FIGS. 4*a* and 4*b* and part of the wall of the shaker to clarify a preferred embodiment, FIG. 6 is a detailed view corresponding to FIG. 2*a* of a further advantageous development of the lid, FIGS. 7*a* and 7*b* are partial sectional views corresponding to FIGS. 4*a* and 4*b* to an enlarged scale to clarify the embodiment of FIG. 6.

FIG. 1 shows a perspective view of a spice shaker having a lid designed in particular for sprinkling various spices. In this embodiment the lid comprises a lid bottom denoted by 2 and a wall 4 extending downwardly at an angle of about 90° and encircling the lid bottom. In the lid bottom 2 sprinkling openings, not shown in FIG. 1, are formed which are closable by flaps 6*a*, 6*b* to 6*f* of a separate plastic member 6. Details of such a construction are described in utility model No. 8,206,774 and utility model No. 8,133,868. It will only be mentioned that the flaps 6*a* to 6*f* of the plastic member 6 are flush with the outwardly directed face of the lid bottom 2 and the sprinkling openings, not shown, are formed in depressed portions of the lid bottom beneath the illustrated flaps 6*a* to 6*f*. The spice shaker designated in FIG. 1 by 8 preferably comprises a plurality of inner partitions 9*a*, 9*b* which are arranged within the shaker 8 in substantially star manner and permit separation between various spices. Generally, the partitions can be omitted if the spice shaker is intended to accommodate a single spice only.

The present invention may be applied to a lid 1 for a spice shaker 8 as described in conjunction with FIG. 1. Details of the lid 1 will be explained hereinafter with reference to FIG. 2. FIG. 2*a* shows a view of the lid 1 reversed with respect to FIG. 1, i.e. the face of the lid bottom 2 directed into the shaker and the inwardly directed face of the wall 4. In the example shown the wall 4 is also made annularly corresponding to the circular form of the spice shaker 8 although the latter and the lid may fundamentally also be of quadrilateral or polygonal form. The wall 4 is provided at its inwardly directed face with a plurality of ribs 10*a*, 10*b*, etc. which extend in the axial direction of the shaker and over the full width of the wall 4, i.e. from the lid bottom 2 up to the edge of the lid 1 denoted by 12. The individual ribs 10*a*, etc. are spaced in predetermined manner apart and have a projecting height compared with the inner face of the wall 4 such that a firm fit of the lid 1 on the spice shaker 8 is ensured. According to a modification of the invention the ribs 10*a*, etc. may have a length smaller than the width of the wall 4 and in this example terminate with their one end face at or near the edge 12 of the wall 4 whilst their end face directed towards the lid bottom 2 is spaced from the latter for example a distance of about 5 to 7 mm. The spacing of the ribs 10*a*, etc. with respect to the lid bottom 2 makes it possible to arrange a small number of transverse ribs which are indicated in dashed line in FIG. 2*a* and provided with the reference numeral 14. In this example of embodiment the transverse ribs 14 are provided near the lid bottom 2 and in the completely engaged state of the lid on the shaker 8 in accordance with FIG. 2*b* are intended to engage an encircling arresting rib 18 formed near the upper edge 16 of the spice shaker. The arresting rib 18 thus has a spacing from the upper edge 16 of at the most about 5 mm. In this manner this achieves the following in this embodiment: when the lid 1 is withdrawn from the spice shaker according to FIG. 2*b* firstly some of the transverse ribs 14 are in engagement with the arresting rib 18. The lid 1 must therefore be withdrawn over about the first 5 mm with comparatively high force application from the spice shaker 8 until all the transverse ribs 14 are out of engagement with the arresting rib 18. Then, only the ribs 10*a*, etc., of the wall 4 extending in the axial direction are still in engagement with the arresting rib 18; as soon as this state is reached the lid 1 can be withdrawn from the spice shaker by applying a comparatively small force. Thus, in this embodiment when the lid 1 is fully fitted a very firm arresting action is achieved between the lid 1 and the spice shaker 8; however, as soon as the lid has been withdrawn through a predetermined region of for example 5 mm the force necessary for removing the lid 1 from the spice shaker 8 becomes comparatively small and the lid can be easily completely removed from the spice shaker 8.

In the embodiment in which the transverse ribs 14 are completely omitted even at the start of the withdrawal of the lid 1 only a small force need be applied to permit detachment of the lid 1 from the spice shaker 8.

At the inwardly directed face of the lid bottom 2 apparent in FIG. 2*a* sealing lips 20*a*, 20*b*, 20*c*, 20*d*, etc. are provided which are formed corresponding to the partitions 9*a*, 9*b* and are in engagement with said partitions 9*a*, 9*b*, etc. as soon as the lid 1 is firmly placed on the shaker 8 as shown in FIG. 2*b*, ensuring a separation of the individual spice compartments of the shaker from each other. The sealing lips may also be partially joined to each other, for example the sealing lip 20*b* to the sealing lip 20*c* via an arcuately extending connecting lip.

FIG. 2*a* further shows the sprinkling openings in the lid bottom 2 which are not shown in FIG. 1 and are of different sizes adapted to the material to be sprinkled, said sprinkling openings being indicated by the reference numerals 15*a*, 15*b*, etc., the reference numerals 17*a*, 17*b*, etc. denoting the securing of the plastic member 6 shown in FIG. 1, for example by riveting, in corresponding openings of the lid bottom 2. FIG. 3 shows a development of the wall 4 to illustrate the embodiment described in conjunction with FIG. 2*a* in which ribs 10*a*, 10*b*, etc. extending in the axial direction of the shaker are provided as well as additional transverse ribs 14. As already mentioned, according to one embodiment the transverse ribs 14 may be dispensed with and the ribs 10*a* can then be extended in FIG. 3 upwardly almost to the lid bottom 2.

FIG. 4*a* shows a partial section of a lid corresponding to the embodiment of FIG. 2*a* and FIG. 3 with the axially extending ribs 10*a*, etc., and the transverse ribs 14, together with part of the lid bottom 2, whilst in FIG. 4*b* a partial section is shown of the embodiment in which the transverse ribs 14 are not provided and the ribs 10*a*, 10*b*, etc. are lengthened compared with FIG. 4*a*.

According to FIGS. 4*a* and 4*b* the ribs 10*a*, 10*b*, etc. preferably have end-face flanks directed at least in the direction towards the edge 12 which rise slightly from the inner face of the wall 4 starting from the lid edge 12 up to the maximum height of the ribs 10*a*, etc., and therefore ensure smooth pushing of the lid 1 onto the edge portion 24 of the spice shaker 8.

In particular with a lid configuration corresponding to FIG. 4*b* with provision only of ribs 10*a*, 10*b*, etc. extending in the axial direction it is preferable to make the spice shaker 8 as follows: the spice shaker 8 comprises an upper edge portion 24 which is formed adjacent the opening of the spice shaker and which merges via a small step 25 into the main body of the spice shaker 8. The edge portion 24 including the step 25 has a height corresponding substantially to the height of the wall 4 of the lid 1. With a cylindrical shaker 8 the edge portion 24 is preferably formed slightly conically, tapering upwardly, and provided with the arresting rib 18 already described and extending substantially centrally of the edge portion 24. In the case of a cylindrical form the spice shaker preferably has at the edge portion 24 a small outer diameter compared with the cylindrical shaker body disposed therebelow.

As already described, in addition to the cylindrical or circular form the spice shaker 8 and the lid may have any other polygonal form without impairing the function on withdrawal of the lid 1 or the arresting of the lid 1 with the aid of the axially extending ribs 10*a*, 10*b*, etc.

The essential point is that the lid, which has the form of a cap, completely surrounds the shaker 8 in the region of its edge portion 24 and seals said shaker with the aid of the wall 4, in particular reliably preventing entrance of moisture between the lid 1 and shaker body 8.

In conjunction with FIGS. 5 to 7 hereinafter preferred embodiments of a lid will be described which corresponding to the above description may be provided with ribs 10*a*, 10*b*, etc. extending in the axial direction of the shaker; however, it is not absolutely essential to provide these ribs.

The lid 1 shown in FIG. 5 in partial section and preferably having a circular form comprises in the transitional region between the lid bottom 2 and the wall 4 an encircling reinforced portion 30 which seen in profile has an inwardly directed stepped profile thereby forming with a circular lid by means of the portion 30 an annular region which is undercut downwardly by a face 31 which is annular in this example. The inner diameter of the lid 1 is greater beneath the face 31 than above the face 31, i.e. the wall portion 4 adjoining the portion 30 has a smaller thickness than the portion 30. FIG. 5 shows the corresponding form of the shaker 8 at the upper shaker edge 24, which is as follows:

The shaker 8 according to FIG. 5 is slightly outwardly widened at 8*a* and defines an edge which is denoted by 32 and on which the lower edge of the lid wall 4 comes to bear as soon as the lid 1 is placed firmly and completely on the shaker 8. The edge 32 has a substantially stepshaped profile. The shaker 8 is tapered by the edge 32 transversely of the axial direction of the shaker so that the edge portion 24 as a whole has smaller outer dimensions for a smaller outer diameter compared with the portion of the shaker 8 lying beneath the edge 32. Advantageously, the edge portion 24 can be further profiled by another tapering or reduction of the outer diameter as shown by the step 34 in FIG. 5, resulting in an upper edge 24*a* with further reduced outer diameter or further reduced outer dimensions.

As clearly apparent from FIG. 5 the annular face 31 forms an undercutting with respect to the portion 30 in such a manner that said portion 30 is given an annular depression by the face 31 and thus an annular flange 36 projects downwardly from the portion 30. The face 31 is provided with a downwardly projecting sealing lip 38 which in the case of a lid 1 extends with circular form circularly within the cutout 40 produced by the face 31 and is provided for sealing engagement at the upper edge of the end portion 24. Advantageously, the annular flange 36 of the lid 1 is in lateral engagement with the upper end of the edge portion 24*a*.

According to a further modified embodiment at the wall 4 of the lid 1 further sealing lips 42, 44 are made in the form of lips which encircle the lid wall inner face and of which the sealing lip 42 lies beneath the sealing lip 38 and the sealing lip 44 is disposed near the lower edge of the wall 4. The sealing lips 38, 42, 44 are preferably made integrally with the lid and have a triangular profile and a thickness of preferably 0.05 to 0.010 mm. The sealing lip 42 cooperates with the annularly encircling step 34 of the shaker 8 whilst the sealing lip 44 ensures a sealing closure between the wall 4 and the shaker edge 24 near the step 32.

The above features can be provided in identical manner in shakers and associated lids which do not have a circular or cylindrical form but a polygonal form. It is pointed out that the form of the sealing lips is not restricted to one of triangular cross-section but that the cross-section may also be serrated, and the tips both with a triangular cross-section and with a serrated cross-section should be directed towards the outer face of the shaker edge 24, the respective sealing lip being bent over in the sealing state.

A sealing of the type described in conjunction with FIG. 5 prevents passage of moisture between the surfaces of the lid on the one hand and the surfaces of the shaker 8 on the other. To ensure good sealing in the region of the sprinkling openings as well said openings, which may have different opening areas, may be formed in similar manner with sealing lips.

FIG. 6 shows a partial view corresponding to FIG. 2*a* with various sprinkling openings 15*a* which are provided with sealing lips 46 still to be described. Details of these sealing lips are apparent in FIGS. 7*a* and 7*b*. In accordance with FIG. 7*a* each lid comprises at its upwardly directed face such sealing lips 46 which are preferably shaped out of the lid and effect a reduction of the open cross-section of the respective sprinkling opening 15*a*. The sealing lips 46 are thus made annular and extending circularly above each sprinkling opening 15*a* and in accordance with FIG. 7*b* by the insertion of serrated projections 50 are pressed slightly or to a greater extent downwardly in the direction towards the shaker interior, as clearly apparent in FIG. 7*b*. As a result each annular sealing lip 46 bears closely on the tooth-shaped projection 50. Such tooth-shaped projections 50 are formed at the lower side of the flaps 6*a* to 6*f* (FIG. 1). Each flap 6*a* to 6*f* comprises a plurality of such tooth-shaped projections 50*a* whose thickness is adapted to the size of the associated sprinkling openings. These tooth-shaped projections 50 also prevent clogging of the sprinkling openings 15*a* by the material being sprinkled when the respective flaps 6*a* to 6*f* assume the closure position shown in FIG. 1 for closing the sprinkling openings. Such projections 50 formed downwardly projecting on the flaps are known per se from German utility models Nos. 8,206,774 and 8,133,868.

A lid or a cap in particular for spice shakers consists of a lid bottom and a wall encircling the lid bottom and projecting downwardly therefrom at a substantially perpendicular angle. The inwardly directing face of the wall is provided with ribs which extend in the axial direction of the shaker, are spaced from each other and on fitting of the lid onto the shaker and removal of the lid from the shaker preferably cooperate with an encircling rib formed at the upper edge portion of the spice shaker.

I claim:

1. A container for holding and dispensing a granular material such as a spice or the like, comprising an open ended housing having a main body terminating in an upper edge portion of a transverse extent which is reduced by a step relative to a transverse extent of the main body, an arresting rib formed on the upper edge portion adjacent to and spaced from an upper end of the container, a closure having a bottom and a wall encircling the bottom and projecting therefrom downwardly at a substantially perpendicular angle, an inner surface of the wall including spaced apart ribs extending in an axial direction protruding inwardly and adapted to frictionally engage the arresting rib, said wall having a height corresponding substantially to the height of said upper edge portion, the ribs being substantially evenly distributed about a circumference of the inner wall surface and terminating at a predetermined distance from the bottom to thereby define an annular range of the wall extending axially over the predetermined distance, and a plurality of transverse ribs located at the annular range of the wall and formed for clampingly engaging said arresting rib of the container for securing the closure to the housing and closing the open end thereof.

2. A container according to claim 1, including a sealing lip extending downwardly from the bottom and formed to engage an upwardly oriented face defined by the container at the upper end thereof.

3. A container according to claim 1, wherein the closure includes a downwardly open annular groove between the bottom and the wall and including a sealing lip disposed in the groove and in contact with the closure and the housing.

4. A container according to claim 1, including at least one sealing lip extending generally radially between the inner wall surface and the upper edge portion and forming a seal between them.

5. A container for holding and dispensing a granular material such as a spice or the like comprising an open ended housing having a main body terminating in an open ended housing having an upper edge portion of a transverse extent which is reduced by a step relative to a transverse extent of the main body, an arresting rib formed in the upper edge portion adjacent to and spaced from an upper end of the container, a closure having a bottom and a wall encircling the bottom and projecting therefrom downwardly at a substantially perpendicular angle, an inner surface of the wall including spaced apart ribs extending in an axial direction, protruding inwardly and adapted to frictionally engage the arresting rib, said wall having a height corresponding substantially to a height of said upper edge portion, the ribs being substantially evenly distributed about a circumference of the inner wall surface and terminating at a predetermined distance from the bottom to thereby define an annular range of the wall extending axially over the predetermined distance, a plurality of transverse ribs located at the annular range of the wall and formed for clamplingly engaging said arresting rib of the container for securing the closure to the housing and closing the open end thereof, the closure bottom further comprising sprinkling openings and lips disposed about and extending radially inwardly relative to the openings, and a sealing flap movably disposed over the closure bottom and including projections arranged to extend axially into and thereby close the openings, the projections including undercuts arranged to sealingly engage the lips, thereby retaining the projections in the openings.

* * * * *